United States Patent [19]

Jackson et al.

[11] 4,152,173

[45] May 1, 1979

[54] METHOD AND APPARATUS FOR TREATING SURFACES OF AN ARTICLE WITH A FLUID ADAPTED TO COAT, CLEAN OR REACT CHEMICALLY WITH THE ARTICLE

[75] Inventors: John M. Jackson, Potters Bar; Roger Wilkins, Welwyn Garden City, both of England

[73] Assignee: Cleamay Ltd., Hertfordshire, England

[21] Appl. No.: 857,858

[22] Filed: Dec. 6, 1977

[30] Foreign Application Priority Data

Dec. 14, 1976 [GB] United Kingdom ..... 52126/76

[51] Int. Cl.[2] ..... B08B 7/04; B08B 9/00

[52] U.S. Cl. ..... 134/10; 134/21; 134/22 R; 134/25 R; 134/30; 134/34; 134/40; 134/48; 134/50; 134/54; 134/105; 134/170; 118/59; 118/602; 427/235; 427/345; 427/350; 427/379

[58] Field of Search ..... 134/10, 12, 19, 21, 134/22 R, 25 R, 30, 34, 40, 48, 50, 54, 95, 105, 109, 158, 168 R, 170; 118/55, 61, 602, 59; 427/235, 345, 350, 379

[56] References Cited

U.S. PATENT DOCUMENTS

| | | | |
|---|---|---|---|
| 1,972,711 | 9/1934 | Kendall | 134/48 X |
| 2,650,178 | 8/1953 | Martin et al. | 134/10 X |
| 2,846,335 | 8/1958 | Alholm et al. | 118/55 X |
| 2,848,353 | 8/1958 | Norris | 427/345 |
| 4,026,311 | 5/1977 | Jackson | 134/48 |
| 4,042,416 | 8/1977 | Miskech | 134/10 |

FOREIGN PATENT DOCUMENTS 1323782 7/1973 United Kingdom.

*Primary Examiner*—Richard V. Fisher
*Attorney, Agent, or Firm*—Browdy and Neimark

[57] ABSTRACT

Apparatus for treating open-mouthed cylindrical containers with a fluid adapted to coat, clean or react chemically with the surface of the containers, comprises a turret fitted with pot assemblies spaced around its periphery, each pot assembly having an internal cavity for reception of a container and a lid for closing the cavity, conduit means for passing fluid through the cavity of each pot assembly, a first pump operable to circulate the fluid in a liquid phase from a reservoir through the conduit means and each cavity so that the liquid flows along the surfaces of a container in the cavity and effects treatment of the surfaces, a second pump operable to circulate the fluid in a gaseous phase from a source thereof through the conduit means and each cavity so as to purge liquid from the cavity, a third pump operable to extract fluid in the gaseous phase from each cavity through the conduit means and thereby reduce the pressure therein so as to effect drying of the container and cavity by vaporization of any liquid therein, and a distributor for connecting each of the pumps in succession to the conduit means of each pot assembly in synchronism with rotation of the turret. The gaseous fluid extracted by the third pump from the pot assemblies is compressed and utilized to form the gaseous fluid used in purging liquid from other pot assemblies. The apparatus is particularly suitable for use with toxic fluids since all the fluid remaining on the containers after treatment is removed therefrom for use in subsequent treatment operations.

14 Claims, 2 Drawing Figures

Figure 1:
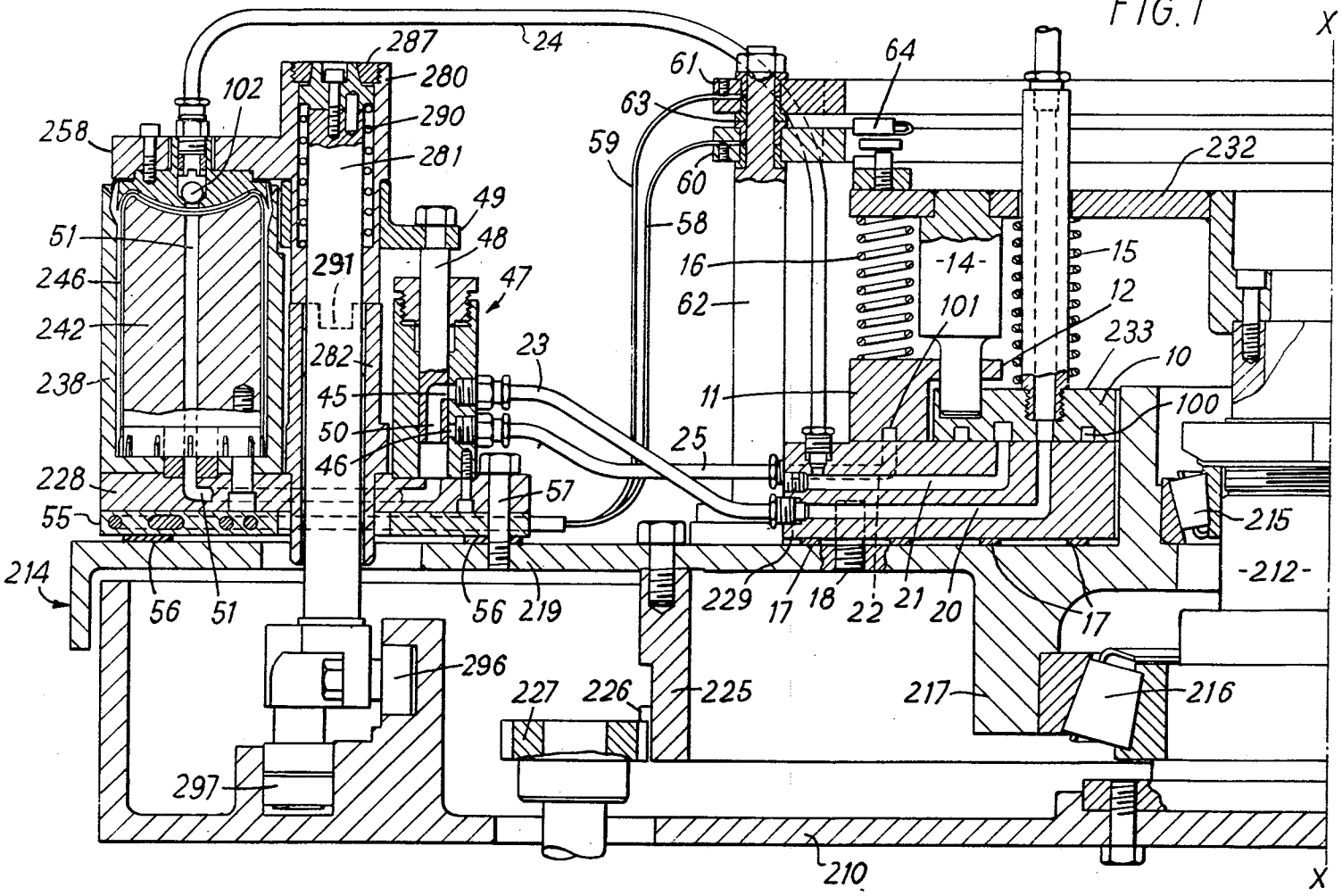

X
X
232
15
12
233
10
100
215
-212-
216
17
-14-
101
20
21
22
18
17
64
217
210
229
225
61
63
60
58
16
62
11
25
59
226
227
24
23
57
219
56
47
49
48
296
280
290
281
287
291
282
45
50
46
102
51
56
297
258
51
246
242
238
228
55
214

METHOD AND APPARATUS FOR TREATING SURFACES OF AN ARTICLE WITH A FLUID ADAPTED TO COAT, CLEAN OR REACT CHEMICALLY WITH THE ARTICLE

This invention relates to the treatment of surfaces of an article with a fluid adapted to coat, clean or react chemically with the article, and has for its object to provide an improved method and apparatus for treating articles with a fluid in which substantially all the fluid remaining on the article after treatment is removed therefrom for use in subsequent treatment operations.

The invention is particularly applicable to the cleaning of open-mouthed metal containers by washing in a toxic cleaning liquid such as, for example trichloroethylene or methyl chloride, but is equally applicable to the surface treatment of metal containers with a liquid adapted to react chemically with the containers to provide a surface layer having particular properties, such as for example improved varnish adhesion.

According to the present invention there is provided a method of treating surfaces of an article with a fluid adapted to coat, clean or react chemically with the article, comprising placing the article in an internal cavity in a body, washing the article by passing the fluid in the liquid phase through said cavity so that the liquid flows along the surfaces of the article to be treated, purging liquid from the cavity by passing a quantity of said fluid in the gaseous phase through the cavity, and subsequently extracting gaseous fluid from the cavity to reduce the pressure therein and effect drying of the article and cavity by vaporisation of any liquid therein. The gaseous fluid extracted from the cavity can conveniently be subsequently compressed and utilised to form the gaseous fluid used in purging liquid in a subsequent treating operation in the same or another cavity. The compression of the fluid may provide the required degree of heating of the fluid to replace the latent heat extracted by the evaporation of liquid in the cavity when at the reduced pressure, but in addition the walls of the cavity are preferably heated by electricity or other means to replace at least part of the latent heat.

In the method of the invention, the space between the article and the walls of the cavity are preferably filled completely with the fluid when passed therethrough in the liquid phase, thereby displacing any air which is present in the cavity. The fluid in the gaseous phase can then be circulated around a closed circuit.

In order to prevent or at least substantially reduce the presence of air in the circuit for the liquid fluid, air which enters the cavity when the article is being placed therein is preferably extracted by vacuum prior to circulation of the liquid.

According to the invention there is also provided apparatus for treating surfaces of an article with a fluid adapted to coat, clean or react chemically with the article, comprising a body having an internal cavity for reception of the article, conduit means for passing fluid through the cavity, said cavity having a shape and size such that fluid passing through the cavity with the article therein flows along the surfaces of the article, a first pump operable to circulate the fluid in a liquid phase from a reservoir thereof through the conduit means and the cavity, a second pump operable to circulate the fluid in a gaseous phase from a source thereof through the conduit means and the cavity, a third pump operable to extract fluid in the gaseous phase from the cavity through said conduit means and thereby reduce the pressure therein, and distributor means operable to connect each of said pumps in succession to said conduit means.

The apparatus of the invention is preferably provided with valve means actuated by the lid to the cavity in the body, the valve means being operable to block communication between the cavity and a source of liquid or gaseous fluid through the conduit means whenever the lid is displaced out of its closed position.

The present invention is particularly applicable to the apparatus for cleaning open-mouthed containers as described and illustrated in the specification of U.S. Pat. No. 4,026,311 filed Mar. 20, 1975 by John Maxwell Jackson. This apparatus comprises a plurality of pot assemblies each having a body and a lid defining a cavity for reception of a container, the lid being movable into an open position to permit introduction of a container into the cavity, means for centering the container in the cavity, the cavity having a shape corresponding approximately to that of the container and a size such that the container subdivides the cavity into two chambers in which the walls of the cavity are spaced close to the inside and outside surfaces of the container, and conduit means for passing cleaning fluid through said chambers so that the cleaning fluid fills the chambers and flows along the inside and outside surfaces of the container. The pot assemblies are supported on a turret rotatably mounted on a frame, the apparatus including drive means operable to rotate the turret so that each pot assembly passes in succession past a container unloading station and container loading station, lid control means operable to move the lid of each pot assembly into an open position immediately prior to passage of the pot assembly past the unloading station and to move the lid into the closed position immediately after passage of the pot assembly past the loading station and valve means for regulating flow of fluids through said conduit means and chambers only during passage of each pot assembly between the loading station and the unloading station.

One construction of a turret machine suitable for applying a toxic cleaning fluid to the surfaces of open-mouthed containers in accordance with the present invention will now be described, by way of example, with reference to the accompanying drawings. The machine shown in the drawings is a modification of the container cleaning machine illustrated in the specification of U.S. Pat. No. 4,026,311 filed Mar. 20, 1975 by John Maxwell Jackson and components corresponding to similar components in U.S. Pat. No. 4,026,311 are identified by reference numbers consisting of the reference number of the corresponding component in U.S. Pat. No. 4,026,311 wih the addition of 200. For example, the base plate is identified by 10 in the drawings of U.S. Pat. No. 4,026,311 and 210 in the drawings accompanying the present specification. Reference should therefore be made to U.S. Pat. No. 4,026,311 for a fuller description of the construction and operation of components shown in the accompanying drawings.

Figure 2:
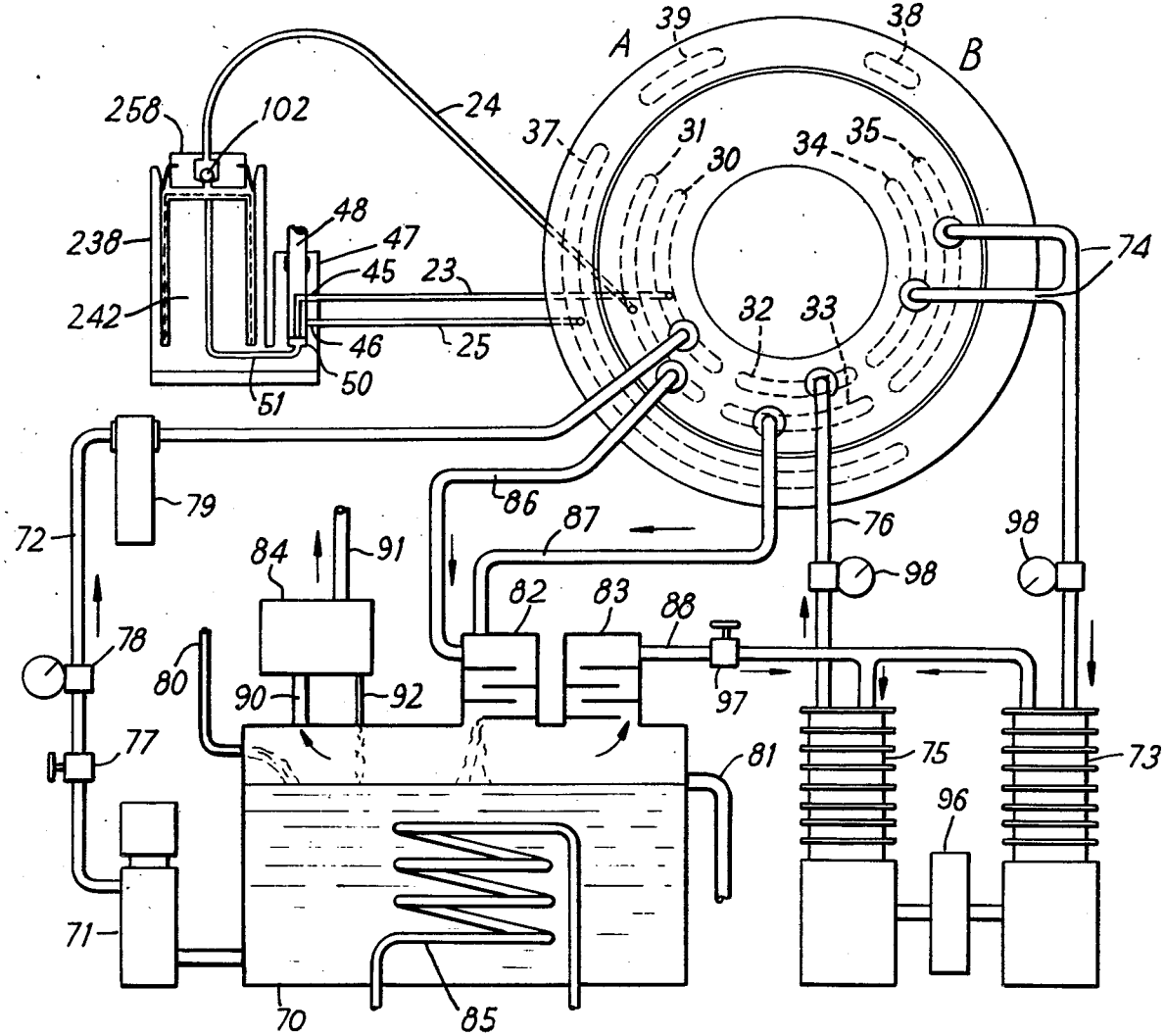

In the drawings:

FIG. 1 is a vertical section view through the rotational axis of the machine showing one half of the machine only, and FIG. 2 shows in diagrammatic form the support equipment required to provide cleaning liquid to the machine and to carry out the purging and drying sequences.

The turret machine comprises a circular base plate 210, an upright spindle 212 secured to the centre of the base plate, and a turret 214 rotatably mounted by bearings 215, 216 on the spindle. FIG. 1 shows only half of the machine on one side of the vertical axis X—X. The turret comprises a hub 217 on which the bearings are mounted, and a circular top plate 219. A cylinder 225 co-axial with the spindle 212 is secured to the underside of the top plate 219, the lower end portion of the cylinder 225 being formed with teeth 226 which mesh with a pinion 227 rotatable by drive mechanism (not shown) for turning the turret. The top plate 219 is fitted with twenty-four pot assemblies 228 (only one of which is shown in the drawings) for reception of the containers to be cleaned, and a manifold ring 229 connected by flexible pipes to the pot assemblies for conveying cleaning, drying and operating fluids to and from the pot assemblies, as described hereinafter. A plate 232 on the top of the spindle 212 supports a distributor ring 233 for feeding fluid into and away from the manifold ring.

Each pot assembly comprises an upright cylindrical shell 238 closed at the bottom but open at the top thereof, a cylindrical core 242 within the shell and a lid 258 which cooperates with the shell and core to form a cavity 246 for the reception of a container to be cleaned. The lid is connected through a slipping clutch 287 to a vertical shaft 281 fitted with cam rollers 296, 297 adapted to run in circular cam tracks on the base plate, the cam rollers being operable to raise the shaft and lid of each pot assembly and pivot the shaft to swing the lid to one side of the shell 238 to permit a cleaned container to be ejected from the pot assembly during passage of the pot assembly past an unloading station during rotation of the turret, and to permit insertion of a container to be cleaned into the pot assembly during passage of the pot assembly past a loading station. The lid 258 is connected to a sleeve 280 on the shaft 281, the sleeve having teeth 291 adapted to engage in recesses in a further sleeve 282 fixed on the turret only when the lid is aligned with the shell of the pot assembly and in the closed position. The lid is urged downwards relative to the shaft 280 by a spring 290 against a stop formed by abutment of the co-operating elements of the slipping clutch 287.

The components of the turret machine described above are similar to corresponding components in the machine described and illustrated in U.S. Pat. No. 4,026,311 and reference may be made to this specification for a fuller explanation of the construction of the pot assemblies and operation of the lids thereof by the cam rollers. The construction and function of the components of the turret machine which differ from those of U.S. Pat. No. 4,026,311 to enable the turret machine to operate in accordance with the present invention, will now be described.

The distributor ring 233 is formed in two parts, namely an inner distributor ring 10 and an outer distributor ring 11. The outer ring 11 has a flange 12 which overlaps the outer edge of ring 10, and the two rings are held stationary by three pegs 14 (only one of which is shown) which extend through apertures in the flange 12 and into recesses in the ring 10, the pegs 14 being secured to the stationary plate 232. The two distributor rings 10, 11 are urged into sliding contact with the manifold ring 229 by springs 15, 16 compressed between the rings and the plate 232. The manifold ring 229 rests on resilient spacers 17 on the top plate 219 of the turret and is connected to the top plate 219 for rotation therewith by three locating pegs 18 (only one of which is shown). The resilient spacers 17 avoid distortion of the manifold and distributor rings and minimise heat loss therefrom.

The manifold ring 229 is provided with three ducts 20, 21, 22 for each pot assembly 228, the three ducts 20, 21, 22 being connected by flexible pipes 23, 24, 25 respectively to the associated pot assembly as hereinafter described. The ducts 20, 21, 22 open through the top surface of the ring 229, the ends of the ducts 20, 21, 22 lying respectively in three common circles concentric with the turret axis. The underside of the inner distributor ring 10 is formed with a first pair of arcuate grooves 30, 31 for circulating liquid cleaning fluid through the pot assemblies, a second pair of arcuate grooves 32, 33 for circulating hot gaseous fluid through the pot assemblies, and a third pair of arcuate grooves 34, 35 for extracting vapour from the pot assemblies to create a vacuum therein. The grooves 30, 32, 34 are all arranged in a common circle and adapted to register in succession with each of the ducts 20 upon rotation of the manifold ring 229 with the turret, and the grooves 31, 33, 35 are all arranged in a common circle and adapted to register in succession with each of the ducts 21 upon rotation of the manifold ring with the turret. The underside of the outer distributor ring 11 is formed with three arcuate grooves 37, 38, 39 arranged in a common circle and adapted to register in succession with each of the ducts 22 upon rotation of the manifold ring with the turret, the groove 37 being connected with a supply of compressed air at a pressure slightly in excess of the cleaning liquid and purging vapour pressures, the groove 38 being connected to a supply of compressed air, and the groove 39 being connected to a vacuum. All the arcuate grooves are connected through openings in the top of the distributor rings to pipes for supplying and exhausting the fluids.

The flexible pipes 23, 25 for each pot assembly are connected to ports 45, 46 respectively in the cylinder of a piston valve 47. The piston 48 of the valve is connected to a stirrup 49 which is mounted on the sleeve 280 of the associated pot assembly so as to permit angular movement of the sleeve relative to the stirrup but prevent relative axial movement therebetween. The piston 48 is thus raised and lowered whenever the lid is opened and closed respectively. The piston 48 is provided with a duct 50 arranged to connect port 45 and pipe 23 to a duct 51 in the base of the pot assembly whenever the lid 258 is in the closed position, the piston being arranged to block port 45 and uncover port 46 to connect pipe 25 and duct 22 to the duct 51 whenever the lid is in the open position. The duct 51 extends upwards through the core 242 and opens in the cavity 246 in the pot assembly.

Each pot assembly 228 is mounted on a platen 55 which rests on insulating washers 56 on the plate 219 of the turret, the platen being secured to the turret by screws 57. The platen 55 is provided with electrical heating elements fed with current through wires 58, 59 and slip rings 60, 61 secured concentrically to the turn table by pillars 62 and insulated therefrom by bushes 63. A current is supplied to the rotating slip rings by brush gear 64 secured to the top of the stationary plate 232.

Referring to FIG. 2, the turret machine is provided with a tank 70 for holding a supply of cleaning liquid, a pump 71 operable to pump liquid from the tank through a pipe 72 to the groove 30 in the inner distributor ring 10, a vacuum pump 73 for extracting cleaning fluid vapour through pipes 74 connected to the grooves 34, 35, and a compressor 75 for compressing cleaning fluid vapour from the pump 73 and tank 70 and supplying the vapour under pressure through pipe 76 to the groove 32 in the inner distributor ring 10. A valve 77, pressure gauge 78 and a filter 79 are fitted in pipe 72.

The tank 70 has an inlet pipe 80 for supply of pure cleaning liquid, an overflow pipe 81 for discharge of contaminated liquid, a flow-smoothing chamber 82 and a vapour separator 83 in the head space of the tank, a condenser 84 for extracting air from cleaning fluid vapour in the tank, and a cooling coil 85. The flow-smoothing chamber 82 is connected by pipes 86, 87 to the grooves 31, 33 respectively in the inner distributor ring 10 for receiving cleaning fluid therefrom, the chamber 82 including a plurality of baffles for smoothing the flow of fluid therethrough. The vapour separator 83 is connected by a pipe 88 to the inlet of compressor 75 and also comprises a plurality of baffles. The condenser 84 has an inlet pipe 90 connected to the head space in the tank, an outlet pipe 91 for discharge of air and vapour to atmosphere or to fluid recovery equipment (not shown), and a return pipe 92 for returning condensed cleaning fluid back to the tank.

The outlet of the vacuum pump 73 is connected by a pipe 95 to the inlet of the compressor 75, and the pump and compressor are driven in synchronism by a common pulley 96 so that vapours exhausted from the vacuum pump are drawn into the compressor at each stroke for recompression. The outlet pipe 88 of the vapour separator 83, which is also connected to the inlet of the compressor, is provided with a valve 97 for regulating the amount of supplementary vapour admitted to the compressor, thus regulating the pressure of vapour delivered through pipe 76. Pipes 74 and 76 are fitted with pressure gauges 98.

As shown in FIG. 1, the underside of the inner distributor ring 10 is provided with concentric grooves 100, 101 adjacent the radially inner and radially outer edges respectively of the ring 10. The grooves 100, 101 are connected by pipes (not shown) to the pipe 74 leading to the inlet of the vacuum pump 73, so that any solvent which may leak across the mating surfaces of the distributor and manifold rings from the grooves 30–33 will be drawn back into the system and thereby avoid wastage and atmospheric contamination. The grooves 100, 101 have been omitted from FIG. 2 in order to show the grooves 30–35 more clearly.

In operation, the tank 70 is filled with volatile cleaning liquid, for example trichloroethylene or methyl chloride, and cleaning liquid is pumped from the tank 70 by the pump 71 through the pipe 72 and filter 79 to the groove 30 in the inner distributor ring 10. The pressure of liquid in pipe 72, as shown on gauge 78, is controlled by the valve 77. When a duct 20 in the manifold ring 229 moves into register with the groove 30 upon rotation of the turret, cleaning liquid in the groove 30 flows through duct 20 and pipe 23 to the piston valve 47 of the associated pot assembly. When the lid 258 of the pot assembly is in the closed position, with the piston 48 in its lowermost position as shown in FIG. 1, cleaning liquid from pipe 23 flows through the duct 50 in piston 48 and through the duct 51 into the cavity 246 in the pot assembly. A container in the pot assembly subdivides the cavity 246 into an inner chamber and an outer chamber, the inner chamber being formed between the inside surface of the container and the core 242 and the outer chamber being formed between the outside surface of the container and the shell 238 together with the lid. The two chambers are of the minimum practical width, for example 0.005 inches, and should preferably not exceed 0.15 inches, so that the cleaning liquid completely fills the chambers, displacing any air therein, and flows through the inner chamber and along the inside surface of the container, around the mouth of the container, through the outer chamber and along the outside surface of the container, before passing out of the cavity through pipe 24 to the groove 31 in the inner distributor ring 10, thereby cleaning the surfaces of the container. The pipe 86 carries the contaminated liquid from groove 31 to the flow-smoothing chamber 82 from which it is discharged back into the holding tank 70.

Continued rotation of the turret causes the pipes 23, 24 of the pot assembly to be disconnected from grooves 30, 31 and connected with grooves 32 and 33 respectively. This is the station in which the cavity in the pot assembly is purged free of cleaning liquid by the introduction of hot vaporised cleaning fluid supplied by the compressor 75 which delivers these vapours to the groove 32 via pipe 76. The cleaning liquid mixed with vapour which is expelled from the cavity in the pot assembly is collected in groove 33 and carried by pipe 87 to the flow-smoothing chamber 82 from which it is discharged into the tank 70

Continued rotation of the turret then causes the pipes 23, 24 to be disconnected from grooves 32, 33 and connected with grooves 34, 35 respectively which are at a high vacuum. The cavity in the pot assembly and all valves, channels and pipe work connected to grooves 34, 35 are then also subjected to vacuum. Due to the low pressure, the temperature of the pot assembly and the container therein is appreciably in excess of the boiling point of the liquid subjected to the low pressure, and residual liquid boils off almost instantaneously from all parts of the system to effect quick drying, and the machine may thus be operated at higher speeds with minimum loss of cleaning liquid due to the expellation of residue when the containers are ejected from the chambers.

Upon further rotation of the turret to bring the pot assembly to position B shown in FIG. 2 the lid of the pot assembly is lifted and swung clear by the cam rollers 296 and 297. Lifting movement of the lid also raises the piston 48 of the valve 47, as hereinbefore described, and thereby connects the duct 51 to pipe 25. When the duct 22, which is connected to pipe 25, registers with groove 38 compressed air from groove 38 flows into the cavity of the pot assembly and ejects the container therein.

When the pot assembly reaches position A shown in FIG. 2 dirty containers are presented to the pot assembly by a mechanism not shown. The duct 22 is then in register with groove 39 and the vacuum therein causes air to be sucked into the cavity and along the pipe 24. This flow of air causes the container to be sucked down into the cavity prior to closure of the lid. In addition air in the chambers between the container and the walls of the cavity is extracted so as to create a vacuum therein immediately prior to closure of the lid. When the lid closes, the piston valve 47 is again in the down position blocking off pipe 25 and connecting pipe 23 to duct 51 for the start of the next cycle.

Groove 37 is in register with duct 22 throughout the cleaning of a container and purging of the cavity, and this groove supplies compressed air to pipe 25 at a pressure slightly in excess of the cleaning liquid and purging vapour pressures so as to prevent back leakage of these fluids through piston valve 47 and into the pipe 25. If such leakage did occur these fluids would be lost to atmosphere when the container was ejected.

It will be appreciated that the purge vapours are heated adiabatically by the compressor 75 and it is not necessary to provide additional heat to the purge vapours.

On the vacuum side there is, of course, heat lost by the system on account of vaporisation within the pot assembly. This heat is however replaced by heat supplied by the electric heating coils in the platen 55.

It is an important feature of the turret machine that, in the event of a container being misfed into a pot assembly, the supply of cleaning fluids to the pot assembly is cut off during the remainder of the cycle, and also the misfed container is ejected before the pot assembly reaches the unloading station B. This ensures firstly that cleaning fluid is not discharged into the atmosphere through a jammed pot assembly, and secondly that any container which is not cleaned is separated out from cleaned containers.

In the event of a container being misfed into a pot assembly, the lid 258 will not be able to swing back to the position above the shell 238 under the influence of cam roller 297. The shaft 281 will turn the slipping clutch 287 and when the shaft is drawn downwards by the cam roller the teeth 287 will not engage with the slots and spring 290 will be compressed. The valve 47 will thus remain in its upper position in which pipe 23 is closed and pipe 25 is open. There will then be no flow of cleaning liquids through pipe 23 and a check valve 102 in the lid prevents back flow of liquid from grooves 30, 32 and pipe 24. As soon as duct 22 moves into register with groove 37, compressed air from this groove will flow through pipe 25 and then through the cavity in the pot assembly, thereby ejecting the faultity-fed container before the pot assembly reaches the unloading station B.

During operation of the machine, a metered flow of pure cleaning liquid is continuously delivered to the tank 70 through pipe 80. This displaces a mixture of emulsion, lubricant and dirty cleaning fluid through pipe 81 which is connected to distillation equipment (not shown), so that the cleaning liquid can be recovered for re-use in the system. The whole system continually gains heat from the electric heaters in the platen 55, and the temperature of the liquid in tank 70 is maintained at a few degrees below boiling point by the thermostatically-controlled cooling coil 85. The system continually gains air since a small volume of air is trapped in the cavity of each pot assembly when the lid is closed. This air saturated with vapour passes up pipe 90 through the condenser 84 to atmosphere or to fluid recovery equipment. The condensed cleaning liquid from condenser 84 runs back into the tank through pipe 92.

The turret machine illustrated in the drawings can conveniently be used to treat the surfaces of containers with a fluid which reacts chemically with the metal of the containers.

Many aluminium containers, for instance, are made from an alloy containing a porportion of magnesium to provide toughness and other qualities required for drawing. Such containers are often varnished after degreasing and the magnesium content inhibits bonding of the varnish film. In water washing systems the surface can be treated during the washing process by the use of water soluble chemicals but such chemicals would be very inconvenient to use in conjunction with solvent washing.

There are however systems which can be compatible and one such system is to treat the surfaces with hot water or water vapour which reacts with the aluminum to form a hydrate having the general formula $Al_2O_3$ $nH_2O$ with the liberation of hydrogen. Such a process is best carried out at a temperature greater than 100° C. and a pressure greater than that of the atmosphere. This is impossible to achieve in normal washing systems which are open to atmosphere, but in the turret machine as described above the pot assemblies can be used as auto-claves permitting the reaction to be carried out at higher pressures and temperatures to speed production.

It has been proposed in a British Pat. No. 1,323,782 (Aluminium Swiss S.A.) to form a surface layer of aluminium hydrate in which said surface is exposed to a gaseous mixture obtained by heating water, an organic solvent the boiling point of which is greater than 100° C. at atmospheric pressure and which can form an azeotripic mixture with water, and ammonia on a volatile amine; the proportion by weight of water in said gaseous mixture being less than the proportion by weight of water in an azeotropic mixture of said solvent and water.

This is said to require an exposure time of 15 to 30 seconds at atmospheric pressure when carried out according to British Pat. No. 1,323,782. If, however, the turret machine as described above is used for this process, temperatures and pressures can be increased and the exposure time reduced to speed up the production rate of the machine. Moreover, the turret machine of the present invention can be used to form a surface layer of aluminium hydrate on aluminium containers by a process similar to that of British Pat. No. 1,323,782 but using an organic solvent having a boiling point less than 100° C. at atmospheric pressure.

The turret machine illustrated in the drawings could also be used to apply to the surfaces of a container a liquid which adheres to the surfaces and then dries or hardens to form a coating, for example a varnish. If the liquid was not toxic, or if the liquid was applied at a temperature and pressure well below that at which there was any serious risk to health due to vaporisation, the vapour purging and evacuating sequences could be omitted and the containers ejected in a wet condition.

We claim:

1. A method of treating surfaces of an article with a treating fluid adapted to coat, clean, or react chemically with the article, comprising placing the article in a pot assembly having a shell and a lid which together with the shell defines a cavity for reception of the article, the cavity having a shape corresponding to that of the article and a size such that the walls of the cavity are spaced close to the surfaces of the article therein, washing the article by passing the treating fluid in the liquid phase through said cavity so that the liquid flows along the surfaces of the article to be treated, purging liquid from the cavity by passing gaseous fluid through the cavity, subsequently extracting gaseous fluid from the cavity so as to reduce the pressure in the cavity to a value at which the temperature of the pot assembly is appreciably in excess of the boiling point of the liquid at that pressure, and supplying heat to the pot assembly to maintain the temperature thereof, so as to effect drying of the article and cavity by vaporisation of any liquid therein.

2. A method as claimed in claim 1, in which the gaseous fluid used to purge liquid from said cavity consists of the vapour of said treating fluid.

3. A method as claimed in claim 2, wherein the treating fluid in the liquid phase is circulated during the washing operation around a first closed circuit including said cavity and a reservoir having head space for vapour from the liquid, and the treating fluid in the gaseous phase is circulated during the purging operation around a second closed circuit including said cavity and said head space in the reservoir.

4. A method as claimed in claim 2 in which a plurality of articles are treated in succession, wherein the gaseous fluid extracted from the cavity is compressed and utilised to form the gaseous fluid used in purging liquid in a subsequent treating operation in the same or another cavity.

5. A method of treating the surfaces of an open-mouthed metal container with a treating fluid adapted to coat, clean or react chemically with the container, comprising placing the container in a pot assembly having a shell, a core and a lid which together with the shell and core forms a cavity for reception of the article, said cavity having a shape corresponding substantially to that of the container and a size such that the walls of the cavity co-operate with the inside surfaces of the container to form a first chamber and co-operate with the outside surfaces of the container to form a second chamber, passing the treating fluid in the liquid phase through said chambers, the walls of said cavity being spaced so close to the inside and outside surfaces of the container that the fluid flows along the surfaces of the container, purging liquid from the cavity by passing gaseous fluid through the cavity, reducing the pressure in the cavity to a value at which the temperature of the pot assembly is appreciably in excess of the boiling point of the treating liquid at that pressure, and supplying heat to the pot assembly to maintain the temperature thereof, so as to effect drying of the article and cavity by vaporisation of any liquid therein.

6. A method as claimed in claim 5, wherein the treating fluid is a degreasing solvent.

7. A method as claimed in claim 5, wherein the treating fluid is a halogenated hydrocarbon selected from the group including trichloroethylene and methyl chloride.

8. Apparatus for treating surfaces of an article with a treating fluid adapted to coat, clean or react chemically with the article, comprising a pot assembly having a shell and a lid which together with the shell defines a cavity for reception of the article, said lid being movable into an open position to permit introduction of an article into the cavity, conduit means for passing fluid through the cavity, said cavity having a shape and size such that fluid passing through the cavity with the article therein flows along the surfaces of the article, a first pump operable to circulate the treating fluid in a liquid phase from a reservoir thereof through the conduit means and the cavity, a second pump operable to circulate gaseous fluid from a source thereof through the conduit means and the cavity so as to purge liquid from the cavity, a third pump operable to extract fluid in the gaseous phase from the cavity through said conduit means and thereby reduce the pressure therein, distributor means operable to connect each of said pumps in succession to said conduit means, and heating means for heating the pot assembly so as to vaporise any liquid in the cavity.

9. Apparatus as claimed in claim 8, including valve means in said conduit means between said distributor means and said cavity, said valve means comprising a valve body and a valve member movable in said valve body between an open position permitting flow of fluid through the conduit means and a closed position blocking flow of fluid through the conduit means, and coupling means connecting the valve member to said lid so that movement of the lid out of its closed position effects movement of the valve member from its open position into its closed position.

10. Apparatus as claimed in claim 8, wherein said second and third pumps have rotary drive shafts coupled together for rotation in synchronism, each of said second and third pumps having an inlet for connection to a source of fluid and an outlet for discharge of fluid, and the outlet of said third pump being connected to the inlet of said second pump.

11. Apparatus as claimed in claim 8 including a tank forming said reservoir of fluid in the liquid phase, wherein said conduit means are arranged to return to the tank fluid passing through the cavity in either the liquid or the gaseous phase, and the head space in the tank is connected to the inlet of said second pump for passage of vapour thereto, means being provided for extracting heat gained by the fluids while passing through the cavity.

12. Apparatus as claimed in claim 11, including a condenser, a feed pipe for feeding vapour and air from the head space in said tank to said condenser, a return pipe for returning condensed fluid to the tank, and a discharge pipe for discharging air from the condenser.

13. Apparatus for treating open-mouthed metal containers of a given size with a fluid adapted to coat, clean or react chemically with the surfaces of the containers, said apparatus comprising a frame, a turret rotatably mounted on said frame, a plurality of pot assemblies supported on the turret, each pot assembly having a core, a shell, and a lid co-operating with said core and shell to define a cavity for reception of one of said containers, means for centering a container in the cavity, the cavity having a shape corresponding approximately to that of the containers and a size such that a container therein subdivides the cavity into two chambers in which the walls of the cavity are spaced close to the inside and outside surfaces of the container, conduit means for passing fluid through said chambers so that the fluid fills the chambers and flows along the inside and outside surfaces of the container, drive means operable to rotate the turret so that each pot assembly passes in succession past a container unloading station and a container loading station, lid control means operable to move the lid of each pot assembly into an open position immediately prior to passage of the pot assembly past said unloading station to permit ejection of a treated container at said unloading station and introduction of a container to be treated into the cavity of the pot assembly at said loading station, said lid control means also being operable to move the lid of each pot assembly into a closed position immediately after passage of the pot assembly past said loading station, a first pump operable to circulate the fluid in a liquid phase from a reservoir thereof through the conduit means and said chambers, a second pump operable to circulate fluid in a gaseous phase from a source thereof through the conduit means and said chambers, a third pump operable to extract fluid in the gaseous phase from the chambers through said conduit means and thereby reduce the pressure therein, and distributor means operable to connect each of said pumps, in succession to said conduit during passage of each pot assembly between said loading station and said unloading station.

14. Apparatus for subjecting surfaces of open-mouthed metal containers of a given size to a fluid treatment, said apparatus comprising a frame, a turret rotatably mounted on said frame, a plurality of pot assemblies supported on the turret, each pot assembly having a core, a shell, and a lid co-operating with said core and shell to define a cavity for reception of one of said containers, means for centering a container in the cavity, the cavity having a shape corresponding approximately to that of the containers and a size such that a container therein subdivides the cavity into two chambers in which the walls of the cavity are spaced close to the inside and outside surfaces of the container, conduit means for passing fluid through said chambers so that the fluid fills the chambers and flows along the inside and outside surfaces of the container, drive means operable to rotate the turret so that each pot assembly passes in succession past a container unloading station and a container loading station, lid control means operable to move the lid of each pot assembly into an open position immediately prior to passage of the pot assembly past said unloading station to permit ejection of a treated container at said unloading station and introduction of a container to be treated into the cavity of the pot assembly at said loading station, said lid control means also being operable to move the lid of each pot assembly into a closed position immediately after passage of the pot assembly past said loading station, and valve means operable should a container fail to feed properly into the cavity of a pot assembly to cut off the flow of treating flud and apply compressed air to eject the faultily-fed container before it reaches the unloading station.

* * * * *

UNITED STATES PATENT AND TRADEMARK OFFICE

CERTIFICATE OF CORRECTION

PATENT NO. : 4,152,173

DATED : May 1, 1979

INVENTOR(S) : Jackson et al.

It is certified that error appears in the above-identified patent and that said Letters Patent are hereby corrected as shown below:

[73] Assignee: Cleamax Ltd., Hertfordshire, England

Signed and Sealed this

*First* Day of *April 1980*

[SEAL]

*Attest:*

SIDNEY A. DIAMOND

*Attesting Officer*

*Commissioner of Patents and Trademarks*